United States Patent [19]

Hansen et al.

[11] 4,156,862

[45] May 29, 1979

[54] ELECTRICAL INDUCTIVE APPARATUS HAVING NON-MAGNETIC FLUX SHIELDS

[75] Inventors: Irvin L. Hansen, Perry; Michael W. Thomas, Hamilton, both of Ind.

[73] Assignee: Westinghouse Electric Corp., Pittsburgh, Pa.

[21] Appl. No.: 879,427

[22] Filed: Feb. 21, 1978

[51] Int. Cl.[2] ..... H01F 15/04

[52] U.S. Cl. ..... 336/73; 336/84 C

[58] Field of Search ..... 310/256; 323/50, 85; 336/84 R, 84 C, 84 M, 73

[56] References Cited

U.S. PATENT DOCUMENTS

| | | | |
|---|---|---|---|
| 1,722,444 | 7/1929 | Reiche | 336/73 |
| 3,523,247 | 8/1970 | Clifford et al. | 336/84 C X |
| 3,577,109 | 5/1971 | Foster et al. | 336/84 M |
| 3,827,018 | 7/1974 | Thomas et al. | 336/84 C |
| 3,867,657 | 2/1975 | Yates et al. | 336/84 C |

*Primary Examiner*—Thomas J. Kozma
*Attorney, Agent, or Firm*—D. R. Lackey

[57] ABSTRACT

The electrical inductive apparatus including non-magnetic flux shields constructed of strips of highly electrically conductive material which are arranged to form a continuous loop around the core window. The shields are disposed parallel to the laminations of the magnetic core and adjacent the top and bottom surfaces of the core. Current induced in the shields by the leakage flux from the windings produces an opposing flux which prevents substantially all of the winding leakage flux from entering the magnetic core.

6 Claims, 4 Drawing Figures

FIG.1
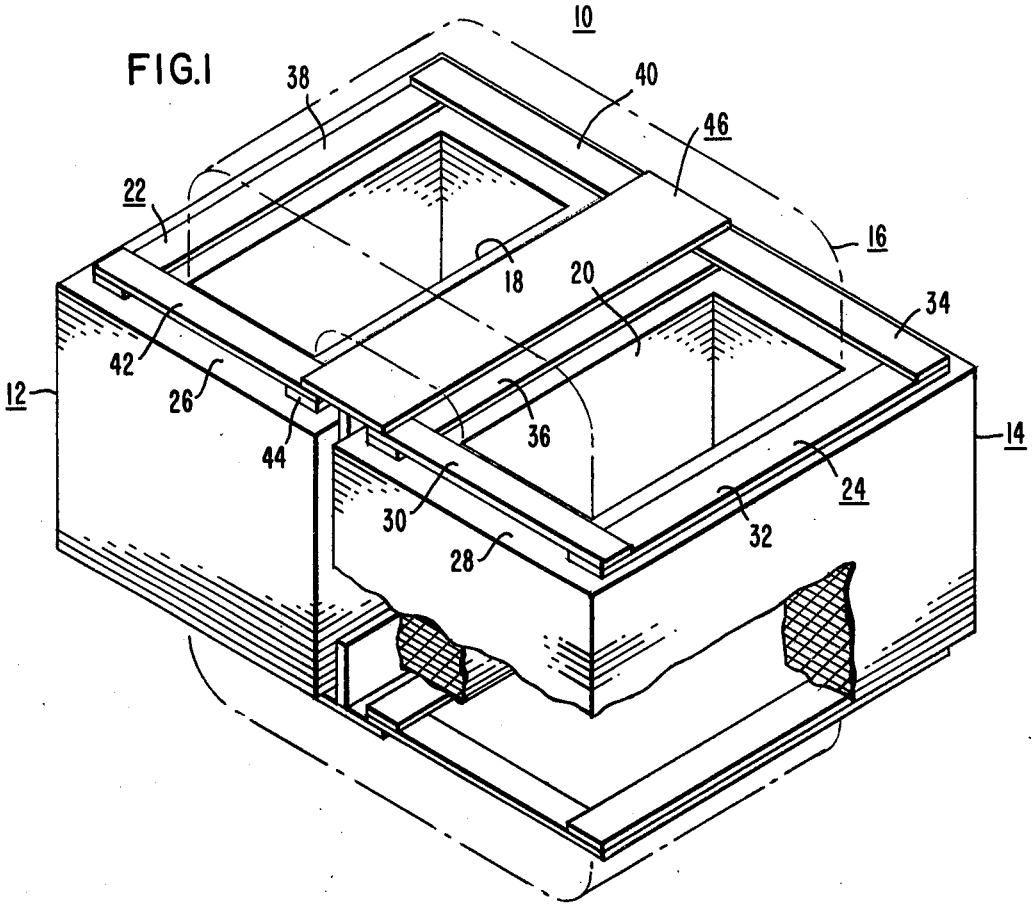
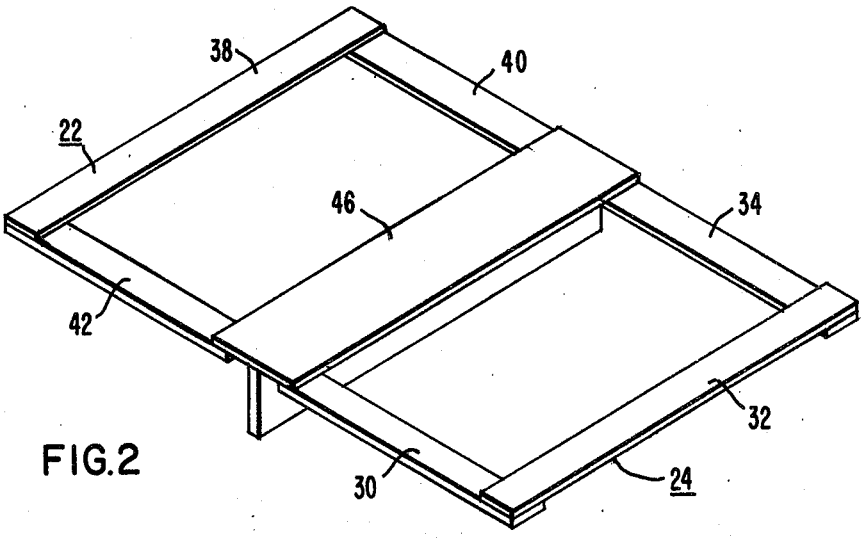
FIG.2

FIG.3
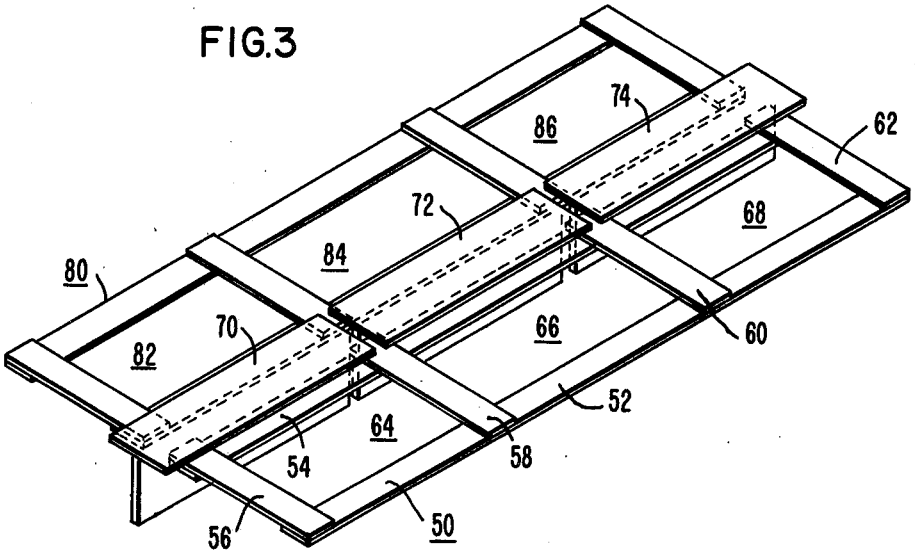
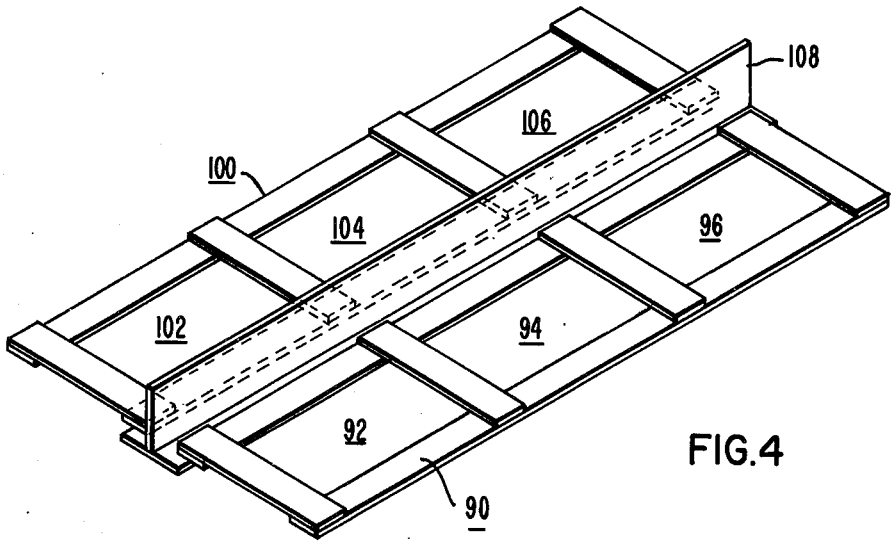
FIG.4

ELECTRICAL INDUCTIVE APPARATUS HAVING NON-MAGNETIC FLUX SHIELDS

BACKGROUND OF THE INVENTION

1. Field of the Invention

This invention relates, in general, to electrical inductive apparatus and, more specifically, to electrical inductive apparatus having leakage flux shields.

2. Description of the Prior Art

In electrical inductive apparatus, such as transformers and the like, the flow of electrical current through the windings produces a magnetic leakage flux which passes through the magnetic core, tank walls and support structure causing overheating therein due to flux induced eddy and circulating currents. Various shielding means have been utilized to reduce the effect of the leakage flux and, thereby, limit overheating of the various components of the transformer. Magnetic shields have been employed on the tongue wedge and T-beam supports, as shown in U.S. Pat. Nos. 2,370,045 and 3,281,745, both assigned to the assignee of the present invention, to conduct the leakage flux along the shield rather than into the support structure. Bundles of magnetic material have been employed, as in U.S. Pat. No. 3,464,041 issued to Waterman, between the windings and core legs to carry the leakage flux to a secondary magnetic core which provides a return path for the flux thereby preventing it from entering the laminations of the core and generating eddy currents therein. Magnetic shields have also been used in U.S. Pat. No. 3,821,677, issued to Boaz and assigned to the assignee of the present invention, to divert the leakage flux from the tank surfaces to a low reluctance path consisting of laminations of ferrite magnetic material which form closed magnetic paths around the windings.

Leakage flux has also been controlled by means of an electrically conductive shield disposed between the turns of the windings, as in U.S. Pat. No. 3,142,029, and between the structural members supporting the transformer in a tank, as in U.S. Pat. No. 3,827,018, issued to Thomas and assigned to the assignee of the present invention. The electrically conductive shields create a counter magnetic field which opposes the leakage flux and thereby reduces the total amount of the leakage flux passing through the shields to the tank and other support structure.

The aforementioned magnetic and electrically conductive shields effectively control the leakage flux in their vicinity. However, stray components of the leakage flux pass through various parts of the transformer not protected by these shields and cause undesirable heating therein. One component or portion of the leakage flux that has not been effectively controlled by the use of prior art flux shields is that component which passes or cuts through the core window. In an electrical transformer, such as a shell-form type, the magnetic core forms a loop around the windings. A voltage is induced around this loop by the winding leakage flux which cuts through the core window. Although the individual core laminations are coated with an insulating material, electrical contact is still made between the laminations through burrs produced in the manufacture of the laminations. These burrs or points of contact form a path for current, forced by the induced voltage, to flow in the magnetic core. When flowing through these points of contact, the current causes hot spots and severe burning of the core laminations which, in turn, produces combustible gasses.

Thus, it would be desirable to provide an electrical inductive apparatus, such as a transformer, having flux shields which prevent the winding leakage flux from entering the core laminations and causing hot spots and the production of combustible gas therein. It would also be desirable to provide an electrical inductive apparatus having improved flux shields which can be installed without substantially increasing the dimensions of the magnetic core and coil assembly of the apparatus.

SUMMARY OF THE INVENTION

Herein disclosed is an electrical inductive apparatus having flux shields which prevent substantially all of the winding leakage flux from entering the magnetic core and causing heating therein. The flux shields are constructed of strips of highly electrically conductive material, such as copper or aluminum, which are arranged to form a continuous loop around the core window. The shields are disposed adjacent the top and bottom surfaces of the magnetic core in proximity with the core windows, with the strips being parallel to the laminations of the magnetic core. The leakage flux from the windings, which would normally pass through the core opening and heat the core laminations, first enters the flux shield. The circulating current induced in the flux shield produces a flux which opposes the leakage flux. Thus, the net flux through the shields is reduced to a relatively small value which prevents substantially all of the winding leakage flux from entering and causing heating of the core laminations.

By preventing substantially all of the leakage flux from entering the core laminations, the novel flux shields of this invention eliminate hot spots in the core and thereby prevent formation of combustible gasses. The flux shields are fabricated from thin strips of electrically conductive material, such as copper or aluminum, which are joined together, such as by welding or brazing, to form a continuous loop around the core opening. In addition, the shield can be formed by using a conductive support member, such as the T-beam, as part of the conducting loop. With this construction, the opening in the winding does not have to be increased to allow room for the shield to be inserted between the winding and the magnetic core.

BRIEF DESCRIPTION OF THE DRAWING

The various features, advantages and additional uses of this invention will become more apparent by referring to the following detailed description and the accompanying drawing in which:

FIG. 1 is a perspective view of an electrical transformer having flux shields constructed according to the teachings of this invention;

FIG. 2 is a perspective view of an electrical transformer having flux shields constructed according to another embodiment of this invention;

FIG. 3 is a perspective view of a flux shield suitable for use on top of a three-phase magnetic core; and FIG. 4 is a perspective view of a flux shield suitable for use below a three-phase magnetic core.

DESCRIPTION OF THE PREFERRED EMBODIMENTS

Referring now to the drawing, and to FIG. 1 in particular, there is shown a single-phase, shell-form transformer constructed according to the teachings of this invention. The transformer includes a magnetic core and winding assembly 10 consisting of magnetic core sections 12 and 14 which are inductively coupled together by electrical winding 16, shown in phantom. In a conventional shell-form type of transformer construction, the magnetic cores 12 and 14 consist of stacked laminations of magnetic material which are arranged in a loop to form an opening or window therebetween, such as core windows 18 and 20. The magnetic core sections 12 and 14 each form a loop around the electrical winding 16, a portion of which is disposed in the core openings 18 and 20. Although other types of winding arrangements may be used, the preferred embodiment of this invention illustrates the use of pancake-type coils for the winding structure 16.

During normal operation of the transformer, current flowing through the winding produces an exciting or magnetization flux perpendicular to the plane of the pancake coils and also a magnetic leakage flux whose lines of flux extend or stray outwardly from the windings. In addition to passing through the transformer support structure, a component or portion of the leakage flux passes through the core window perpendicular to the laminations of the magnetic core. This component of the leakage flux induces a voltage in the magnetic core which causes a current to flow around the core through the burrs or points of contact between the individual laminations of the magnetic core. Current flow through the burrs or points of contact causes severe burning and hot spots in the core laminations which, in turn, generates combustible gases.

Referring again to FIG. 1, there is shown flux shields 22 and 24 which prevent substantially all of the leakage flux from entering the core laminations. The flux shields 22 and 24 are disposed adjacent the top surfaces 26 and 28 of the magnetic core sections 12 and 14. Similar flux shields, not shown, are disposed adjacent the bottom surfaces of the magnetic core sections 12 and 14. Each flux shield consists of thin strips or plates of highly electrically conductive material, such as copper or aluminum, which are arranged to form a loop around the core opening adjacent both the top and bottom surfaces of each magnetic core section 12 and 14. Thus, flux shield 22 consists of strips 38, 40, 42 and 44; while flux shield 24 is formed of strips 30, 32, 34 and 36. Since each flux shield for the single-phase magnetic core and coil assembly 10 shown in FIG. 1 is identically constructed, only flux shield 24 will be described in detail hereafter. The strips 30, 32, 34 and 36 of the flux shield 24 are disposed adjacent the top surface 28 of the magnetic core section 14 parallel to the laminations of the core section 14 in a continuous loop around the core window 20. The individual strips comprising each flux shield are joined together by suitable means to form a conductive path around the core window of each magnetic core section. According to the preferred embodiment of this invention, the ends of the individual strips 30, 32, 34 and 36 are overlapped to form a continuous loop around the core window 20. Pressure exerted by the winding 16 and the upper T-beam 46 on the individual strips 30, 32, 34 and 36 is sufficient to hold the strips in position without additional joining necessary. It is also contemplated that the ends of the individual strips 30, 32, 34 and 36 may be welded or brazed together to form the conductive path. Furthermore, each flux shield, such as flux shield 24, may be constructed by using a conducting support member, such as T-beam 46, as part of the conducting loop around the core window 20 as shown in FIG. 2. In this construction, the T-beam 46 forms one leg of the flux shield 24. This arrangement provides dimensional advantages since the opening in the winding assembly 16 does not have to be increased to allow room to insert the flux shields 22 and 24.

Each flux shield 22 and 24 operates in the following manner. The leakage flux that would normally pass through the core openings 18 and 20 of the magnetic core sections 12 and 14, respectively, first enters the flux shields 22 and 24 and induces a voltage therein. The voltage causes current to flow around each flux shield 22 and 24 which, in turn, induces a flux therein which opposes or counteracts the leakage flux that would normally enter the core windows 18 and 20. The shields 22 and 24 are sized to generate sufficient opposing flux such that the net flux passing through the flux shields 22 and 24 is reduced to such a small value that the amount of leakage flux penetrating the flux shields 22 and 24 is insufficient to produce hot spots within the laminations of the magnetic core sections 12 and 14.

In addition, the cross-sectional area of each strip comprising the flux shields 22 and 24 is chosen so as to limit the temperature rise in each shield. The individual strips of each flux shield 22 and 24 are placed adjacent the core windows 18 and 20 in order to provide the shortest current path around the magnetic core sections 22 and 24 and, further, to generate the maximum opposing flux since the leakage flux density is greatest in the region immediately adjacent the electrical winding assembly 16.

While this invention has been illustrated in conjunction with a single phase transformer of the shell-form type, it will be understood that it applies equally as well to single or polyphase electrical apparatus, and to transformers of the core-form type, as well as to reactors and any high voltage apparatus having a magnetic core and winding assembly. Regardless of the type of magnetic core construction utilized, the flux shields are constructed so as to form a continuous loop around the core window immediately adjacent the top and bottom surfaces of the magnetic core.

Referring now to FIGS. 3 and 4, there are respectively shown flux shields constructed according to the teachings of this invention which are arranged to form continuous loops around each core window of a three-phase magnetic core. In a three-phase shell-form magnetic core construction, each magnetic core section is formed of stacks of metallic laminations arranged to define top and bottom surfaces with a core opening or window extending therethrough. Two magnetic core sections are associated with each phase of the transformer and are disposed in spaced side-by-side relation with the adjacent portions of the magnetic core sections forming at least one winding leg therebetween. An electrical winding assembly is provided for each phase of the transformer and includes a plurality of conductor turns which extend through the core openings of each of the two magnetic core sections in each phase of the transformer to encircle the so-called winding leg formed therebetween.

FIG. 3 depicts three-phase flux shields 50 and 80 which are constructed according to the teachings of this invention. Flux shield 50 includes electrically conductive strips 52 and 54 which extend the entire length of the three-phase magnetic core and coil assembly, not shown. Individual strip members 56, 58, 60 and 62 are disposed with their ends overlapping the strips 50 and 54 and are spaced apart to form conducting loops 64, 66 and 68 which correspond to individual magnetic core sections of the three-phase magnetic core assembly. The flux shield 50 is disposed parallel to the laminations of the three-phase magnetic core and adjacent the top surface of the three-phase magnetic core beneath the T-beam members 70, 72 and 74 which support the electrical winding assembly during construction. As noted previously, the individual strip members comprising the flux shield 50 may be welded or brazed together or may utilize the T-beam members 70, 72 and 74 as a part of each conducting loop 64, 66 and 68.

Upper flux shield 80 is constructed in the same manner as flux shield 50 and consists of individual strips of highly electrically conductive material arranged to form conducting loops 82, 84 and 86 around the remaining magnetic core sections of the three-phase magnetic core assembly.

FIG. 4 depicts flux shields 90 and 100 which are associated with the bottom surface of the three-phase magnetic core assembly. Flux shields 90 and 100 consist of individual strips of electrically conductive material arranged to form conducting loops 92, 94 and 96 and 102, 104 and 106, respectively. The flux shields 90 and 100 are disposed adjacent the bottom surface of the three-phase magnetic core assembly and with the plane of the shields 90 and 100 being parallel to the laminations of the magnetic core. In addition, the flux shields 90 and 100 are supported by the lower T-beam support 108. As described previously with respect to the upper flux shields 50 and 80, the bottom or lower flux shields 90 and 100 may have the individual strip members disposed with their edges overlapped, welded or brazed together, or may utilize the lower T-beam support 108 as one part of each conducting loop.

It will be apparent to one skilled in the art that there has been herein disclosed an electrical inductive apparatus having flux shields which prevent substantially all of the portion of the winding leakage flux that passes through the core window from entering the magnetic core and causing hot spots and the formation of combustible gas therein. The flux shields are easily constructed of strips of electrically conductive material which are arranged in a continuous loop and disposed adjacent the top and bottom surfaces of the magnetic core in proximity with the core window. In addition, the use of thin strips of electrically conductive material to form the flux shields enables the shields to be inserted immediately adjacent the top and bottom surfaces of the magnetic core without substantially increasing the dimensions of the opening in the windings.

What is claimed is:

1. Electrical inductive apparatus comprising:

a magnetic core formed of a plurality of stacks of metallic, magnetic laminations arranged to define at least one window for receiving a winding assembly, said at least one window extending between first and second surfaces of the magnetic core, with said first and second surfaces being defined by the major flat surfaces of the outermost laminations of said plurality of stacks of laminations;

an electrical winding assembly disposed in inductive relation with said magnetic core and having a portion extending through the at least one window of said magnetic core, said electrical winding assembly producing a magnetic leakage flux having a component which is perpendicular to the first and second surfaces of said magnetic core; and a flux shield formed of a plurality of plates of electrically conductive, non-magnetic material having flat major surfaces, said plurality of plates being disposed adjacent to at least one of said first and second surfaces of said magnetic core, between said at least one surface and said electrical winding assembly, with the major flat surfaces of the plurality of plates being parallel with said at least one surface, said flux shield forming a continuous, electrically conductive path around the at least one window of said magnetic core, such that the leakage flux from said electrical winding assembly which links said flux shield will induce an electrical current flow therein having a magnetic flux which opposes and cancels at least a portion of said leakage flux, to reduce the amount of leakage flux entering the laminations of said magnetic core.

2. Electrical inductive apparatus of claim 1 wherein the plurality of plates of the flux shield include first, second, third and fourth plates, each having first and second ends, with the first and second ends of said first, second, third and fourth plates being overlapped to create electrically conductive connections between the plates, to form the continuous, electrically conductive path around the the at least one window of the magnetic core.

3. Electrical inductive apparatus of claim 1 wherein at least certain of the plates of the flux shield are constructed of copper.

4. Electrical inductive apparatus of claim 1 wherein at least certain of the plates of the flux shield are constructed of aluminum.

5. A shell-form power transformer comprising:

first and second magnetic core sections, each formed of a plurality of stacks of metallic, magnetic laminations arranged to define a window for receiving a winding assembly, said window extending between first and second major flat surfaces of the magnetic core, with said first and second surfaces being defined by the major flat surfaces of the outermost laminations of said plurality of stacks of laminations, said first and second magnetic core sections being disposed in spaced side-by-side relation with the adjacent portions and the windows of said first and second magnetic core sections forming at least one winding leg therebetween;

an electrical winding assembly disposed in inductive relation with said first and second magnetic core sections, said electrical winding assembly including a plurality of conductor turns disposed to encircle said at least one winding leg, said electrical winding assembly producing a magnetic leakage flux having a component which is perpendicular to the first and second surfaces of said first and second magnetic core sections; and first, second, third and fourth flux shields, each formed of a plurality of plates of electrically conductive, non-magnetic material having major flat surfaces, with the plurality of plates of each of said first, second, third and fourth flux shields being disposed adjacent to a different one of said first and second surfaces of said first and second magnetic core sections between the associated surface and said electrical winding assembly, with the major flat surfaces of the plurality of plates being parallel with the associated surface, each of said flux shields forming a continuous electrically conductive loop around the window of the associated magnetic core section, such that the leakage flux from said electrical winding assembly which links the flux shields will induce electrical current flow therein having a magnetic flux which opposes and cancels at least a portion of said leakage flux, to reduce the amount of said leakage flux which enters the laminations of said first and second magnetic core sections.

6. The transformer of claim 5 further including a support member having a portion disposed between the adjacent portions of the first and second magnetic core sections and a portion disposed adjacent at least one of the first and second surfaces of said first and second magnetic core sections, said support member forming a portion of at least one of the first, second, third and fourth flux shields.

* * * * *